United States Patent [19]

Cowan

[11] Patent Number: 4,852,319

[45] Date of Patent: Aug. 1, 1989

[54] COMBINATION VOID DRAIN VENT CHAIN

[76] Inventor: John D. Cowan, 2436 Brixton Rd., Columbus, Ohio 43221

[21] Appl. No.: 246,236

[22] Filed: Sep. 19, 1988

[51] Int. Cl.[4] ..... E04B 1/70

[52] U.S. Cl. ..... 52/302; 52/303; 52/310; 52/380

[58] Field of Search ..... 52/310, 302, 303, 304, 52/380

[56] References Cited

U.S. PATENT DOCUMENTS

| | | | |
|---|---|---|---|
| 2,565,937 | 8/1951 | Verhagen | 52/304 |
| 3,344,567 | 10/1967 | Cowan et al. | 52/99 |
| 4,706,418 | 11/1987 | Stewart | 52/303 X |

FOREIGN PATENT DOCUMENTS

| | | | |
|---|---|---|---|
| 3137410 | 3/1983 | Fed. Rep. of Germany | 52/303 |
| 632289 | 11/1949 | United Kingdom | 52/302 |

*Primary Examiner*—David A. Scherbel
*Assistant Examiner*—Lan Mai
*Attorney, Agent, or Firm*—John L. Gray

[57] ABSTRACT

A combination void drain vent chair for use in the construction of voided concrete shapes, including an elongated tube connecting the interior of the void form to the exterior of the concrete shape, and including a flat flexible member surrounding the upper end of the tube which may be attached to the under surface of the void form so that the void drain vent chair may be conveniently used with void forms that are circular in cross section, as well as those that are rectangular in cross section.

7 Claims, 1 Drawing Sheet

COMBINATION VOID DRAIN VENT CHAIN

BACKGROUND OF THE INVENTION

In precast or poured-in-place voided concrete shapes, disposable internal void forms are used, which are either rectangular or circular in cross section and are made out of corrugated paper, wound solid fiber, wood or expanded polystyrene. These void forms remain in the shape after it is cast. In order to vent accumulated moisture and methane gas which is sometimes generated in the void, it is necessary to provide void drains.

A void drain of the prior art is shown in U.S. Pat. No. 3,344,567. This is placed on the upper portion of the base form and is held in place by longitudinally extending steel strands adjacent the bottom of the shape which provide the necessary reinforcing in the shape. The strand itself, resting on shoulders of the void drain, can hold the void drain in place or a wire can be used to hold down the void drain between two strands. The void form rests on top of a plurality of the void drains prior to pouring the concrete. Since the top of the void drain tube is merely in contact with the undersurface of the void form, it is necessary to have the top of the void drain tube closed to prevent concrete from entering the void drain tube between any space that might exist between the top of the void drain tube and the bottom of the void form. Thus, the upper end of the tubular drain portion of the void drain is an integral cover and after the completion of the manufacture of the beam, the cover is opened by punching a hole through the frangible knock-out cover of the void drain and then through the void form thus permitting draining of water and any gas that accumulates therein. Such a void drain of the prior art may be used with void forms that are both rectangular and circular in cross section. However, in order properly to position them, the circular cross-sectional forms must be otherwise supported with wires, etc., since prestressing strands do not normally occur directly under the circular void forms and are not present at all in poured-in-place voided concrete shapes. Therefore the void drains represented by U.S. Pat. No. 3,344,567 are not particularly well suited for use with round void forms for poured-in-place voided concrete shapes.

SUMMARY OF THE INVENTION

Applicant's invention is an improvement on the prior art in that it is fixedly attached to the void form and may be used where there are no reinforcing strands available and is particularly adapted for use in conjunction with void forms which are circular in cross section.

Applicant's invention forms the additional function of supporting the void form so that external wire arrangements do not have to be employed. This is especially useful in connection with void forms that are circular in cross section.

It is therefore an object of this invention to provide a combination void drain vent chair which may be fixedly attached to the underside of a void form in a reinforced voided concrete shape that is either precast or poured-in-place which will insure communication between the void and the exterior of the shape without further action after the shape has been made.

It is a further object of this invention to provide such a combination void drain vent chair which will position the void form correctly during the concrete pouring operation.

It is still a further object of this invention to provide such a combination void drain chair which will permit drainage from the interior of the void without staining the underside of the beam.

These, together with other objects and advantages of the invention will become more readily apparent to those skilled in the art when the following general statements and descriptions are read in light of the appended drawings.

DETAILED DESCRIPTION OF THE INVENTION

Figure 1:
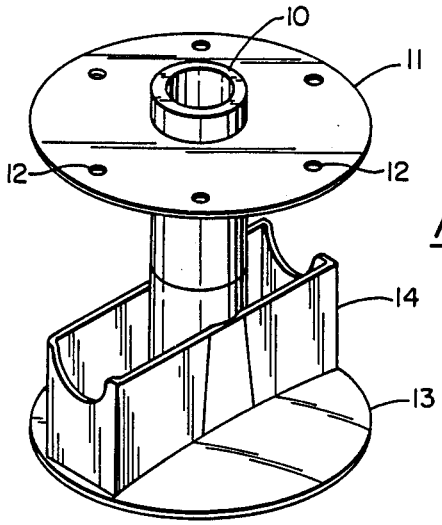
FIG. 1 is a perspective view of the combination void drain vent chair of applicant.

Referring now more particularly to FIG. 1, the combination void drain vent chair comprises a hollow tube 10. Spaced from the upper end of hollow tube 10 is a circular flat flexible member 11, preferably integral with said hollow tube 10 and provided with a plurality of equi-spaced holes 12-12 extending through said flat flexible member 11 and adapted to receive wood or metal screws. Other fastening devices such as rivets, staples, tape, caulk, nails, glue, etc. may also be used. While it is preferable that member 11 be flexible so that it may be used on void forms that are circular in cross section as well as rectangular, this invention also contemplates members 11 being rigid and concave in shape and which have a radius comparable to that of specific standard circular void shapes.

Attached to hollow tube 10 is base member 13 which is provided with an upstanding shoulder forming unit 14 which may be used in conjunction with tie down strands in the beam being constructed.

Figure 2:
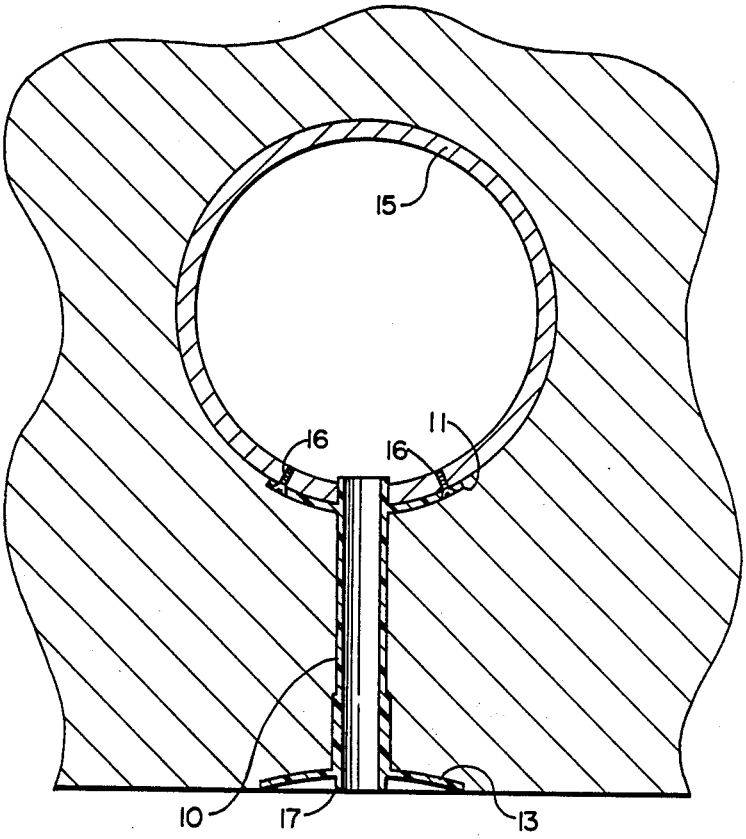
FIG. 2 is a side elevational sectional view showing the void drain vent chair of applicant attached to a void form circular in cross section.

Referring now more particularly to FIG. 2, there is shown a void form 15 circular in cross section into which the hollow tube 10 of the combination void drain vent chair has been inserted, and the flexible member 11 has been firmly attached to the void form 15 by means of wood screws 16—16.

It will be noted that base member 13 is convex in shape and slightly spaced from the bottom of tube 10 so that a drip lip 17 is established to insure that the moisture drips downwardly at that point and does not have a tendency to run along the under surface of the slab.

In use, the combination void drain vent chair has the tube inserted in a hole in the void form 15 which is drilled through to accommodate the tube 10 and the flexible member 11 is fixedly attached to the void form 15 by means of fastening devices, such as the sheet metal screws 16—16 shown. A number of such combination void drain vent chairs are positioned as needed along a center line of the void form 15 and then the unit is placed on the base form of the beam to be cast. If there are appropriate steel reinforcing strands spaced from the plywood base form, the combination void drain vent chair can be inserted thereunder by placing the shoulder 14 under the appropriate strands if they are conveniently so positioned or using wire to tie down the combination void drain vent chair to the strands. If there are no strands, the base 13 may be fastened to the base form in order to fixedly secure the void drain vent chair and the attached void form 15 in position.

The height of tube 10 above flexible member 11 is designed to approximate the thickness of the thickest type of void form in commercial use. For most applications the upper end of tube 10 will either be even with the interior surface of the void form or very slightly above it, thus permitting good drainage of any fluids in the void form. The combination void drain vent chair preferably has an advesively attached removable protective paper or fabric cover (not shown) on the base 13 covering portion 17 thereof which is removed from the base 13 after the forms are separated from the newly formed concrete surface.

Thus, it will be seen that the improved combination void drain vent chair of applicant may be used whether prestressing strands are present or not and also enables the void form to be used without further use of wires, etc. The flexible member 11 enables the combination void drain vent chair to be attached to void forms that are both rectangular and circular in cross section.

While this invention has been described in its preferred embodiment, it is to be appreciated that variations therefrom may be made without departing from the true scope and spirit of the invention.

What is claimed is:

1. A combination void drain vent chair comprising:

an elongated tube having an upper and a lower end, a flat member attached to said upper end of said tube, said flat member being spaced from said upper end of said tube and projecting laterally therefrom, and being sufficiently flexible to conform to the shape of and to be attached to a hollow tubular void form, a base member attached to said tube adjacent to said lower end of said tube.

2. The combination void drain vent chair of claim 1 wherein said flat flexible member is provided with a plurality of equi-spaced holes extending through said flexible member.

3. The combination void drain vent chair of claim 1 wherein said base member is spaced from the lower end of said tube and is convexly shaped so that the periphery of said base member is substantially in the same plane as said lower end of said tube.

4. The combination void drain vent chair of claim 1 wherein said flat flexible member is integral with said tube.

5. The combination void drain vent chair of claim 1 wherein said base member is integral with said tube.

6. The combination void drain vent chair of claim 1 wherein there is shoulder-forming means integral with said tube and projecting laterally therefrom at a location spaced above said base member.

7. In a reenforced hollow concrete shape containing a void space, a combination void drain vent chair for said shape comprising an elongated tube having an upper and a lower end, said upper end extending into said void space, a flat flexible member surrounding said upper end of said tube and exterior of said void space, said flat flexible member being spaced from said upper end of said tube and projecting laterally therefrom, and being provided with a plurality of equi-spaced holes extending through said flexible member encircling said tube, and being sufficiently flexible to conform to the shape of and to be attached to a hollow tubular void form, a base member projecting laterally from said tube and encircling said lower end of said tube.

* * * * *